United States Patent [19]

Ohayon et al.

[11] Patent Number: 4,493,271

[45] Date of Patent: Jan. 15, 1985

[54] COAL OR MULTIFUEL BURNER

[75] Inventors: Gérard Ohayon, Loriol; Bernard Reverchon, Bouc Bel Air; Bernard Tourre, Ensues-la-Redonne; Serge Vigier, Sausset-les-Pins, all of France

[73] Assignee: Lafarge Conseils et Etudes, Paris, France

[21] Appl. No.: 468,417

[22] Filed: Feb. 22, 1983

[30] Foreign Application Priority Data

Feb. 22, 1982 [FR] France ..... 82 02891

[51] Int. Cl.[3] ..... F23K 5/00

[52] U.S. Cl. ..... 110/262; 431/186; 431/183; 431/353; 110/263; 110/264

[58] Field of Search ..... 110/260–265; 431/183, 186, 353

[56] References Cited

U.S. PATENT DOCUMENTS

| | | | |
|---|---|---|---|
| 3,042,105 | 7/1962 | Bitterlich | 431/353 |
| 3,049,085 | 8/1962 | Musat et al. | 431/183 |
| 3,115,851 | 12/1963 | Ceely | 110/264 |
| 3,299,841 | 1/1967 | Hemker et al. | 431/183 |
| 3,934,522 | 1/1976 | Booker | 431/186 |
| 4,032,287 | 6/1977 | Blum et al. | 431/278 |
| 4,096,808 | 6/1978 | Trickel | 110/244 |
| 4,147,116 | 4/1979 | Graybill | 110/263 |
| 4,157,889 | 6/1979 | Bonnel | 110/263 |
| 4,206,712 | 6/1980 | Vatsky | 110/264 |
| 4,279,206 | 7/1981 | Pitts et al. | 110/347 |
| 4,321,034 | 3/1982 | Taccone | 110/264 |
| 4,333,405 | 6/1982 | Michelfelder et al. | 110/265 |
| 4,373,900 | 2/1983 | Eckelman | 110/263 |

*Primary Examiner*—Henry C. Yuen

*Attorney, Agent, or Firm*—Frost & Jacobs

[57] ABSTRACT

The object of the invention is to permit, for operation with coal by itself, easy adjustment of the flame length without varying the gas flow and with a relatively stable flame divergence. The burner according to the invention comprises a cylindrical tube (1) through which an air/fuel mixture is ejected into the flame, and inside which a coaxial cylindrical part (6) can move along the axis in order to permit adjustment of the output speed of the gas. Advantageously, this part (6) constitutes a means for injecting air and fuel-oil for mixed operation or operation with fuel-oil by itself.

1 Claim, 5 Drawing Figures

COAL OR MULTIFUEL BURNER

BACKGROUND OF THE INVENTION

The present invention relates to a burner using a pulverised fuel.

The recent changes in the price of petroleum products have led to increased interest in burners using a pulverised fuel, in particular coal, and multifuel burners capable of using a solid fuel, a liquid fuel or both at the same time.

The burners commonly used for a liquid or solid fuel comprise two concentric tubes, one of which supplies an air/fuel mixture, this mixture being formed before it is sent to the burner, or alternatively being formed in the burner or at its nozzle, and the other of which supplies pure air and provides it with a rotational movement about the axis. This rotational movement combines with the axial displacement of the gas stream to give a helical movement, which serves to control the divergence of the flame. This air is frequently called "rotational air". The term "pure air" must obviously be understood as meaning any combustion gas not mixed with the fuel, for example oxygen-enriched air.

In some designs, the air/fuel mixture is sent through the peripheral tube of the burner and the rotational air through the central tube, whereas, in other cases, this arrangement is reversed. In either arrangement, an even more central tube, through which additional pure air is sent, is sometimes provided along the axis of the burner.

At constant heat throughput, a flame can be defined by its length and its divergence. It has been found that, for a burner of given geometry, the length of the flame decreases when the speed of the gases ejected by the burner increases, this apparently paradoxical fact resulting from the influence of the turbulences in contact with the secondary air not ejected by the burner. More precisely, it has been found that the length of the flame is approximately inversely proportional to the square root of the axial momentum, that is to say the product of the mass flow of gas and its average axial speed. The divergence of the flame depends on the ratio A/R, A being the gas flow in axial movement (air/fuel mixture plus any additional pure air) and R being the flow of rotational air.

In a coal-fired tubular kiln, for example a cement kiln, it is desirable to operate with a constant flame divergence, and it is necessary for this divergence to be small because of the proximity of the refractory lining and because of the corrosive nature of the coal ash in the molten state. On the other hand, it is desirable to be able to modify the flame length at will, because this factor controls the temperature gradient in the kiln, which is an important parameter in the cement industry because of the physico-chemical phenomena which result therefrom.

With a burner of conventional type, in order to modify the flame length, the axial momentum can only be changed by altering the gas flows, because the speed of the gas streams is fixed by their flow and by the geometry of the burner. If it is desired to modify the flame length without varying the divergence, it is necessary to alter both the flow of axial air and the flow of rotational air simultaneously, in order to keep the ratio A/R at a constant value. This has disadvantages. Two simultaneous adjustments are required and this leads to complications. By altering the flow of air/fuel mixture, it is likely that it will also be necessary to modify the amount of fuel and hence the amount of energy released. In fact, the composition of the air/fuel mixture can only be controlled within relatively narrow limits, because this mixture is not generally formed in the burner itself, and it must carry the fuel into the burner under satisfactory conditions. However, if the total gas flow is varied without modifying the fuel flow, variations in the energy released are nevertheless observed as a result of the following phenomenon: the total amount of air which leaves the burner only represents part of the air used in the flame, the remainder being secondary air taken from the kiln itself. The air sent into the burner is cold, whereas the secondary air is hot; consequently, a variation in the ratio of the flow of the secondary air to the flow of the air delivered by the burner results in an undesirable variation in the flame temperature.

It can be seen that the running of a kiln equipped with a pulverised coal burner is a complicated technique which is difficult to control.

SUMMARY OF THE INVENTION

The object of the present invention is to overcome these disadvantages and, in particular, to provide a burner in which the flame length can be modified in a simple manner without changing the other characteristics of the flame, such as the divergence or the energy released.

Another object of the invention is to provide a burner of this type which can also be used as a multifuel burner for liquid and solid fuel, or as a burner for liquid fuel by itself.

The invention therefore provides a burner using a pulverised solid fuel and comprising a cylindrical tube through which an air/fuel mixture is ejected into the flame, the main characteristic of the burner being that, inside the said tube, a coaxial cylindrical part can move along the axis between a position near the end of the said tube and a more retracted position, in order to allow the adjustment of the axial momentum of the gas stream.

Thus, the idea on which the present invention is based consists in altering the axial thrust, which governs the flame length, not by modifying the gas flow but by changing the geometry of the burner so as to change the speed of ejection of a gas stream, namely the stream of the air/fuel mixture, without modifying its flow.

This new concept has consequences in terms of the actual structure of the burner. In particular, the usual structure, in which the injection of fuel into the gas stream takes place along the axis of the burner, leads to difficulties as regards the erosion resistance of the centering and adjusting members of the movable coaxial part. This problem has been solved by adopting a structure in which the air/fuel mixture arrives obliquely in the cylindrical tube, the coaxial part being provided with a shield for protection against erosion by the particles of solid fuel. This structure in turn leads to the risk of accumulation of fuel dust in the cylindrical tube, behind the point of arrival of the air/fuel mixture. This new difficulty has been solved by converting this zone to a pressurised chamber. Thus, according to an advantageous embodiment, provision is made for the inner wall to be arranged essentially just behind the point of arrival of the air/fuel mixture in the tube, and to form an angle equal to at most 10° with the direction of arrival of this mixture.

Other problems then arose, namely that of fixing the shield and that of fixing the inner wall. A shield fastened to the coaxial part must have a long length, namely the sum of the length of the zone subjected to erosion for a given position of the coaxial part, and of the latitude of displacement of the latter, and this results in a high price. Fixing the shield and the inner wall to the cylindrical tube made any dismantling very difficult. The solution is that the protective shield and the inner wall are carried by a supporting part which is fitted in the tube and the dimensions of which are sufficient also to protect the internal surface of this tube from erosion by the fuel particles.

The burner according to the invention is a solid fuel burner which can operate without rotational air and without additional air. According to an advantageous feature of the invention, it can be converted to a burner capable of operating as a multifuel burner or with liquid fuel by itself. In this case, the movable axial part is a central tube provided with an axial nozzle for injecting a liquid fuel, and with means for imparting a rotational movement to a gas which passes between this central tube and this nozzle, that is to say, in practice, for producing rotational air. Advantageously, this central tube is provided with a detachable blocking means which is located near its end and which serves to prevent the deposition of solid fuel dust in this central tube when it is not in operation.

DESCRIPTION OF THE DRAWINGS

The invention will now be described in greater detail with the aid of non-limiting practical embodiments of a burner, illustrated by the drawings; in these drawings.

DESCRIPTION OF THE PREFERRED EMBODIMENT

Figure 1:
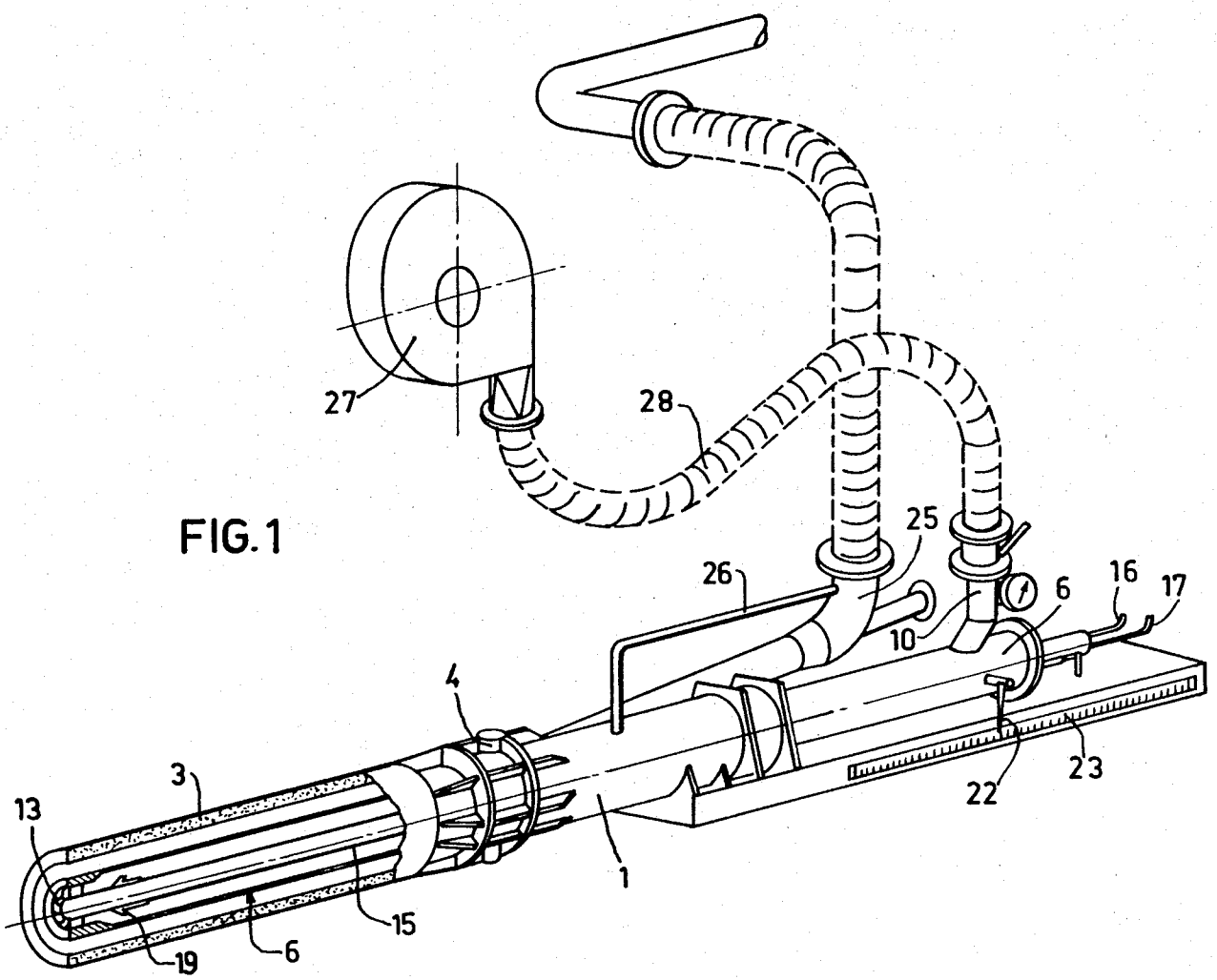
FIG. 1 is a perspective view of the burner in partial section.
Figure 2:
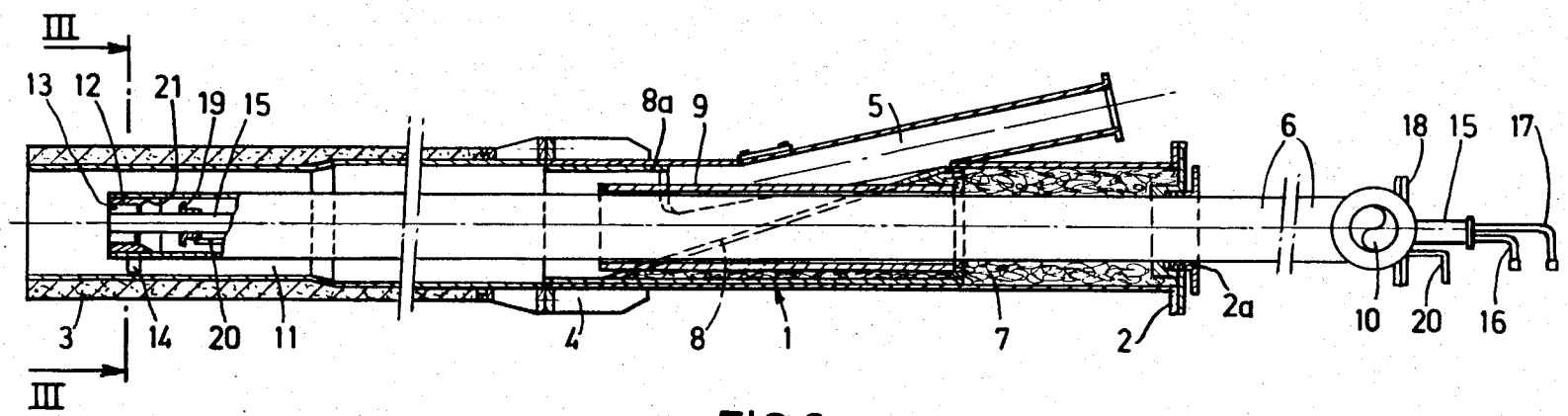
FIG. 2 is a view of the same burner in longitudinal section.

The burner shown by way of example comprises a cylindrical tubular body 1 made of steel, blocked at its rear end by a part 2, which forms an end wall, and surrounded at its front end by a lining 3 of refractory material. Means 4 for fixing the burner to a movable fitting are provided in the central part of the body 1. A duct 5 for supplying the air/coal mixture comes out inside the body 1, to which it is joined at a very small angle, of the order of 15°, upstream of the fixing means 4.

A cylindrical central tube 6 made of steel is arranged inside the body 1, extends beyond the rear end of the latter and passes through the part 2 via a stuffing box **2*a*, which permits axial displacement of this central tube with an easy fit. This stuffing box is mounted loose in the part 2 so that it can adapt to a possible deformation of the central tube 6. According to a modified embodiment which is not shown, the stuffing box 2*a* is located behind the part 2 and is joined thereto by a leaktight and deformable connector. The rear part 7 of the annular space existing between the body 1 and the central tube 6 is filled with a glass fibre packing from the end part 2 up to an oblique partition 8, which is located just upstream of the point where the duct 5 comes out into the tube 1**, and forms an angle of the order of 20° with the axis of the tube, that is to say 5° with the direction of arrival of the air/coal mixture.

The oblique partition 8 is fastened to a support piece **8*a*, which is in the shape of a tube fitting tightly inside the tubular body 1. This support piece possesses a lateral opening, which corresponds to the point where the duct 5 for supplying the air/coal mixture comes out. In its central part, the oblique partition 8 possesses a passage through which the protective shield 9 passes. The latter consists of a tube in two parts separated by an axial plane. The part facing the rear of the stream of the air/fuel mixture is made of silicon carbide and the part facing the opposite side is made of special steel, which is not as strong as the carbide but is less expensive. The internal diameter of the tubular shield 9 is calculated so as to enable the central tube 6 to pass through it without rubbing, but with reduced play. In fact, the temperature conditions do not allow a stuffing box to be provided at this point. To prevent the coal dust from entering the chamber 7**, the latter is placed under an excess pressure of the order of 30 millibars.

The unit formed by the oblique partition 8, the support piece **8*a* and the shield 9 can easily be removed by sliding it in the body 1. It will be noted that, towards the front, the support piece 8*a* extends beyond the oblique partition 8 and thus contributes to protecting the inner face of the body 1 from abrasion by the coal particles arriving obliquely, if appropriate after having passed round the shield 9** or bounced off the latter.

At is rear end, the central tube 6 is joined to a pure air supply 10.

To obtain a suitable speed of ejection, the body 1 comprises, at its front end, a part 11 of smaller internal diameter, and, for the same purpose, the central tube 6 also comprises a part of smaller internal diameter, 12, at its front end. Helical fins 13 are arranged in this narrowed part 12 so as to cause the air passing through the latter to rotate.

On the outside and at its front end, the central tube 6 carries two supporting bosses 14, which bear against the inner face of the body 1 and slide over the said face, and ensure that the central tube is centered correctly relative to the body 1.

The central tube 6 can move between an "extreme front" position, where its front end is level with the front end of the tube 1, and an "extreme rear" position, where its front end is in the region of the rear end of the part of smaller diameter, 11, of the tube 1. The central tube can occupy any intermediate position.

The central tube 6 also comprises a nozzle 15 arranged along its axis. Two injection pipes, not shown, are located inside this nozzle and are joined, at the rear, to two fuel-oil supply ducts 16 and 17, respectively "high pressure" and "low pressure" ducts, according to common practice. The central nozzle 15 extends as far as the front end of the central tube and is intended for mixed operation with a liquid fuel in addition to the solid fuel, or for operation with a liquid fuel by itself. Of course, the diameter of this nozzle is less than that of the narrowed part 12 of the central tube, so as to allow the combustion air to pass through freely.

The nozzle is held firm and in a leaktight manner by the rear flange 18 of the central tube 6, and it is centered relative to the latter by the fins, slightly behind its part of small diameter, 12.

An annular disc 19 is mounted so as to slide over the nozzle 15 and is fastened to a control rod 20, which comes out of the tube 6 at its rear end. The disc 19 can come into contact with the frustoconical surface 21 which constitutes the transition between the part of larger diameter of the central tube 6 and the narrowed part 12 of the latter, in order to form a valve preventing the coal from returning into this tube in the case where the air flow stops or decreases.

The external equipment of the burner, such as shown in FIG. 1, comprises means for displaying the position of the central tube 6, which are represented by a cursor 22, fastened to this tube, and by a graduated rule 23. It is obvious that many other position indicators can be used. The supply of air/coal mixture comprises an injection device 25 joined to the duct 5. A take-off 26 joins the chamber under excess pressure, 7, to a point in the air supply to this device which is located upstream of the point of arrival of the coal. Thus, this chamber is automatically placed under excess pressure when air/-coal mixture is sent to the burner.

The pure air supply 10 to the central tube 6 is joined to a fixed fan 27 via a flexible duct 28 capable of absorbing the large displacements of up to 1.25 m of this central tube. The same applies to the fuel-oil supply nozzles 16, 17.

In a modified embodiment, not shown, the injection device 25 and the pure air supply 10 are joined to the same source of air supply.

The burner operates as follows:

(1) With pulverised coal by itself, the valve 19 is in the forward position and the pure air is cut off. The coal is therefore mixed with all the air used. There is only one adjustment, namely that of the axial momentum by displacement of the central tube 6. It is found that the divergence is virtually constant and of the order of 22°.

(2) With fuel-oil by itself or for mixed operation, the valve 19 is retracted and the central tube 6 is in the forward position. Pure air sent through the central tube 6 is caused to rotate while fuel-oil is sent through the central nozzle 15. Depending on the particular case, either air with pulverised coal, or pure air, is sent through the annular space between the tubes 1 and 6. Adjustment is then carried out as in the existing burners by simultaneously adjusting the flame length and the divergence.

Figure 4:
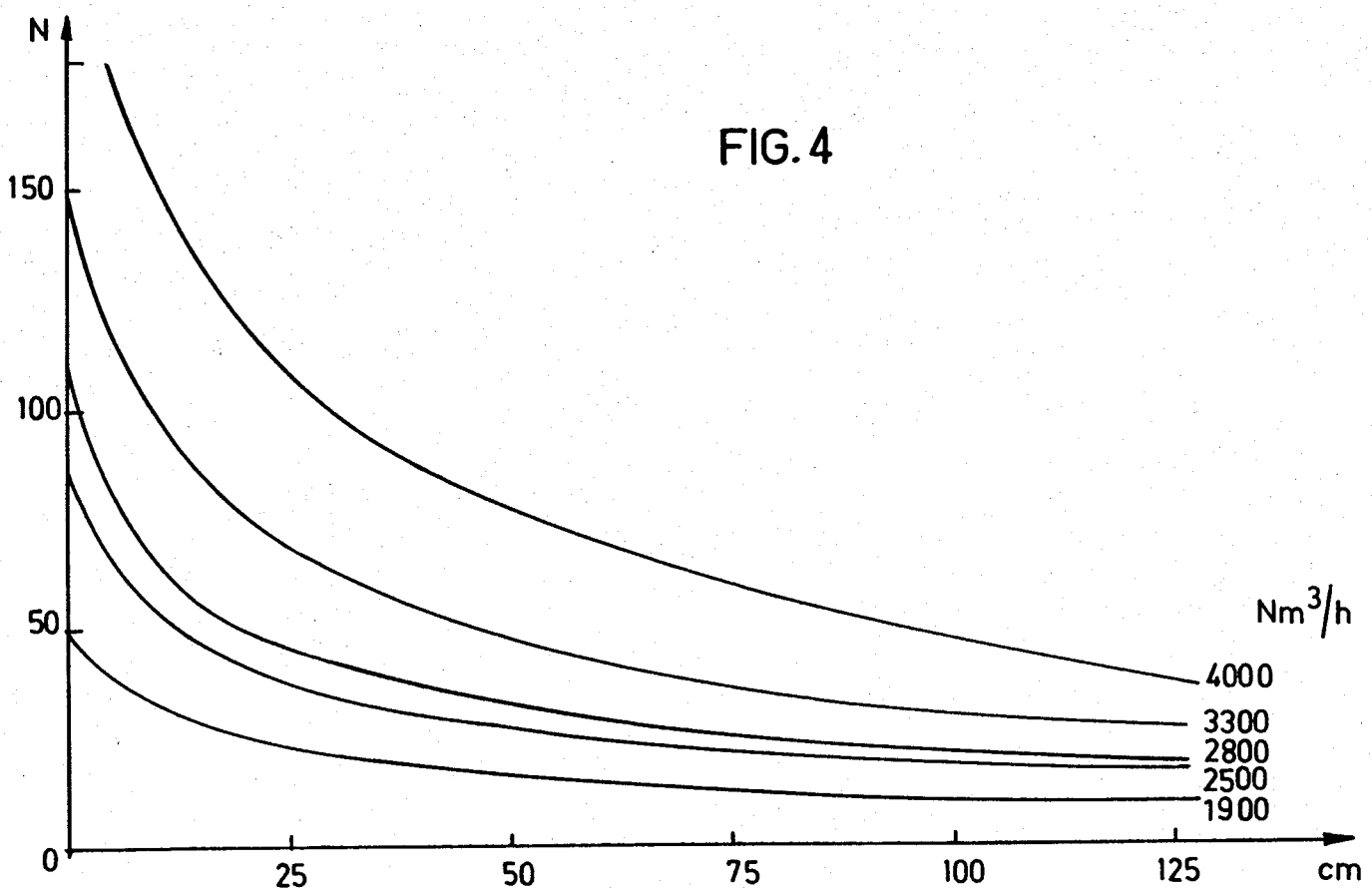
FIG. 4 is an experimental graph showing the variation in the axial thrust as a function of the position of the cylindrical part.

FIG. 4 shows the possible adjustments in the case of operation with pulverised coal by itself, that is to say with the valve 19 in the forward position and with the central tube 6 blocked and acting in the same way as a solid cylindrical part. This figure shows the axial thrust in Newtons as a function of the retraction, that is to say of the distance from the front end of the central tube 6 to the front end of the tube 1, for various values of the gas flow in $Nm^3$/hour. The internal cross-section of the tube 1 in its narrowed part 11 was 564 $cm^2$ and the external cross-section of the tube 6 was 471 $cm^2$.

By way of example, it is found that for a flow of 1,900 $Nm^3$/hour, a change in retraction from 0 to 100 cm corresponds to a change in the axial thrust from 50 to 10N, which, for the flame, results in a change in length in a ratio of about 2.24 to 1. For a flow of 3,300 $Nm^3$/hour and a change from 10 to 100 cm, the axial thrust changes from 155 to 30N, which results in a change in flame length in essentially the same ratio.

Figure 5:
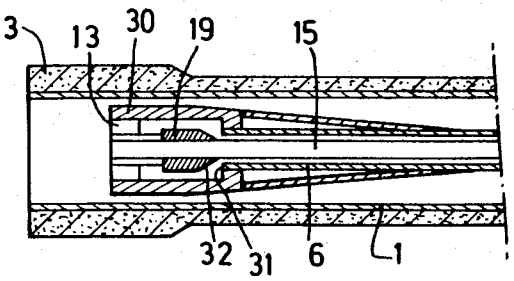
FIG. 5 is a view of a preferred modified embodiment in partial longitudinal section.
Figure 3:
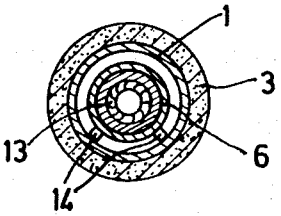
FIG. 3 is a cross-section along the line A—A of FIG. 2.

In the modified embodiment which forms the subject of FIG. 5, the differences involve the front part of the burner.

The body 1 keeps the same diameter up to the end and is protected in this zone by a lining 3 of refractory material of increased thickness.

The increase in the speed of ejection is achieved by virtue of the fact that the central tube 6 comprises a part 30 of larger external diameter.

This part 30 also has an increased internal diameter, and the connection between the two internal diameters is formed by a shoulder 31.

The inner nozzle 15 centered in the central tube 6 by the helical fins 13 supports the sliding blocking device 19, which, this time, is not in the shape of a disc but terminates at the rear in a frustoconical part 32. This frustoconical part comes to bear on the shoulder 31 in order to close the tube 6. When the blocking device 19 is in the forward position, it effects a decrease in the cross-section of the tube 6 so as to give the appropriate speed of ejection of the air sent through this tube.

It is self-evident that other burners give different results, but, in the case of operation with coal, as indicated, wide ranges of variation in flame length are always observed for a relatively stable divergence.

We claim:

1. A burner for use with pulverized solid fuels, said burner comprising a cylindrical tube through which an air/fuel mixture is ejected into the flame, characterized in that a coaxial cylindrical part is movably mounted within said cylindrical tube, the passageway for the air/fuel mixture consisting of the annular space between said cylindrical tube and said coaxial cylindrical part, said cylindrical part being movably axially from a position in which its outermost end lies adjacent to the outermost end of said cylindrical tube to a retracted position in which its outermost end lies inwardly relative to the outermost end of said cylindrical tube, whereby to permit adjustment of the axial momentum of a gas stream flowing through said burner, means for obliquely introducing the air/fuel into said cylindrical tube at a point remote from the outermost end thereof, said coaxial cylindrical part being provided with a shield in the area where the air/fuel mixture is introduced into said cylindrical tube, whereby to protect the cylindrical part from erosion by the particles of said solid fuel, a closed chamber positioned to the rear of the point where the air/fuel mixture is introduced, said chamber being bounded at one end by an end wall fitted with a snuffing box for the cylindrical part and at its opposite end by an inner wall through which the cylindrical part passes, means for placing said chamber under excess pressure, said inner wall being positioned essentially just behind the point at which the air/fuel mixture is introduced and forms an angle of not more than 10° with respect to the path of travel of the air/fuel mixture as it enters the cylindrical tube, said protective shield and said inner wall being carried by a supporting part fitted within the cylindrical tube and positioned to protect the inner surface of the cylindrical tube from erosion by the particles of fuel, said cylindrical part being provided with means for imparting rotational movement to a gas passing therethrough, together with a nozzle for injecting a liquid fuel, said cylindrical part being provided with a detachable blocking means adjacent its outermost end, said detachable blocking means being slidably mounted for movement relative to the nozzle for ejecting a liquid fuel, said cylindrical part having a frustoconical surface positioned to be engaged and closed by the blocking means when displaced toward the outermost end of the cylindrical part, thereby blocking the flow of gas through the cylindrical part.

* * * * *